US006065358A

United States Patent [19]

Shepherd

[11] Patent Number: 6,065,358

[45] Date of Patent: May 23, 2000

[54] STACK-HEIGHT SENSOR

[75] Inventor: Larry Wayne Shepherd, Glen Allen, Va.

[73] Assignee: Philip Morris Incorporated, Richmond, Va.

[21] Appl. No.: 09/201,352

[22] Filed: Dec. 1, 1998

[51] Int. Cl.[7] ..... B65G 43/08

[52] U.S. Cl. ..... 73/865.8; 131/910

[58] Field of Search ..... 73/865.8, 432.1, 73/597; 33/721, 732, 755, 757, 759, 760, 832, 501.02, 501.03, DIG. 7; 131/910

[56] References Cited

U.S. PATENT DOCUMENTS

| | | |
|---|---|---|
| 3,596,797 | 8/1971 | Wallenborn . |
| 3,995,732 | 12/1976 | Figes et al. . |
| 4,023,669 | 5/1977 | Clarke . |
| 4,120,391 | 10/1978 | Molins et al. . |
| 4,200,181 | 4/1980 | Clarke . |
| 4,344,520 | 8/1982 | Czoch et al. . |
| 4,350,242 | 9/1982 | Hinchcliffe et al. . |
| 4,359,152 | 11/1982 | Czoch et al. . |
| 4,421,223 | 12/1983 | Molins et al. . |
| 4,599,699 | 7/1986 | Stewart-Cox et al. . |
| 4,641,024 | 2/1987 | Neri . |
| 4,774,840 | 10/1988 | Turner . |
| 4,790,422 | 12/1988 | Clarke et al. . |
| 4,903,713 | 2/1990 | Clarke . |

*Primary Examiner*—Robert Raevis
*Attorney, Agent, or Firm*—Connolly Bove Lodge & Hutz

[57] ABSTRACT

An arrangement determines the height of a multilayer stream of articles such as the rod-shaped cigarettes of the tobacco industry. The arrangement includes a flexible elongate member connected to move up and down with the uppermost articles in the multilayer stream as the height thereof varies. The flexible elongate member has a first end fixed in place and an opposite end connected to a weight which moves in a vertical direction as the flexible elongate member moves up and down in response to the height of the multilayer stream of articles. The flexible elongate member is trained around an idler roller, and a sensor is spaced directly below the weight for determining the elevation thereof. Such elevation is directly related to the height of the multilayer stream of articles. A conveyor system having a variable drive moves the multilayer stream of articles along a predetermined path of travel, and a control between the sensor and the conveyor drive varies the drive in response to varying elevations of the weight. When the weight is further away from the sensor, the height of the multilayer stream is excessive, and the conveyer drive is decreased to thereby lower the height of the stream to within predetermined levels. Conversely, when the weight is closer to sensor, the height of the multilayer stream is low, and the conveyor drive is increased to raise the height of the multilayer stream to within predetermined levels.

12 Claims, 1 Drawing Sheet

STACK-HEIGHT SENSOR

BACKGROUND OF THE INVENTION

The present invention relates to an arrangement for determining the height of a multilayer stream of articles and maintaining that height to within predetermined levels. More particularly, the arrangement is utilized in combination with a conveyor system having a variable drive that increases conveyor speed when the height is low and decreases conveyor speed when the height is excessive. These conveyor speed adjustments maintain the multilayer stream of articles to within predetermined levels.

In the tobacco industry it is common to convey multilayer streams of rod-shaped cigarette articles from the manufacturing stage to packaging. Moreover, it is common to detect the height of such streams at convenient locations, and to control the conveying speed of the multilayer stream so that the level thereof remains within predetermined limits. U.S. Pat. No. 4,774,840, granted Oct. 4, 1988, discloses a detector of this type and the disclosure thereof is incorporated herein by reference.

Similarly, U.S. Pat. No. 4,641,024, granted Feb. 3, 1987, shows a conveyor system for conveying cigarettes from a cigarette manufacturing machine along a plurality of channels to a packaging machine. The level of the cigarettes in one or more of the channels is measured by an analog-type level detector which generates a continuous output signal used to continuously control the speed of the convey system.

SUMMARY OF THE INVENTION

One of the objects of the present invention is an arrangement for determining the height of a multilayer stream of articles wherein the actual determination of the height is made at a location remote from the multilayer stream of articles.

Another object of the present invention is an arrangement for determining the height of a multilayer stream of articles which is relatively inexpensive and reliable for use in controlling the height of the multilayer stream.

In accordance with the present invention, an arrangement is provided for determining the height of a multilayer stream of articles such as rod-shaped cigarettes, for example. The arrangement comprises a flexible elongate member connected to move up and down with the uppermost articles in the multilayer stream as the height thereof varies. The flexible elongate member has a first end fixed in place and an opposite end to which a weight is secured for movement with the flexible elongate member in response to height variations of the multilayer stream. The flexible elongate member is trained about an idler roller, and a sensor is spaced directly below the weight for determining the elevation thereof. Such elevation is directly related to the height of the multilayer stream of articles.

Preferably, the arrangement for determining the height of the multilayer stream of articles includes an anti-sway device positioned between the idler roller and the weight arranged to engage the flexible elongate member and thereby prevent the weight from swaying. Moreover, the weight preferably comprises a pair of L-shaped elements secured to one another in back-to-back relationship with the flexible elongate member sandwiched there between. Collectively, the L-shaped elements have an inverted T-shape.

The sensor preferably includes a transmitter for directing sound onto the weight and a receiver for receiving sound reflected from the weight. The delay in receiving sound transmitted towards and reflected from the weight is measured to thereby provide an indication of the elevation of the weight and the height of the multilayer stream of articles.

The arrangement for determining the height of the multilayer stream of articles is utilized in combination with a conveyor system having a variable drive for moving the stream of multilayer articles along a predetermined path of travel. A control between the sensor and the conveyor drive functions to vary the drive in response to varying positions of the flexible elongate member and its associated weight. When the height of the multilayer stream of articles is excessive, the conveyor drive is decreased to lower the height to within predetermined limits. Conversely, when the height of the multilayer stream of articles is low, the conveyor drive is increased to thereby raise the height to within predetermined limits.

BRIEF DESCRIPTION OF THE DRAWINGS

Novel features and advantages of the present invention in addition to those discussed above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
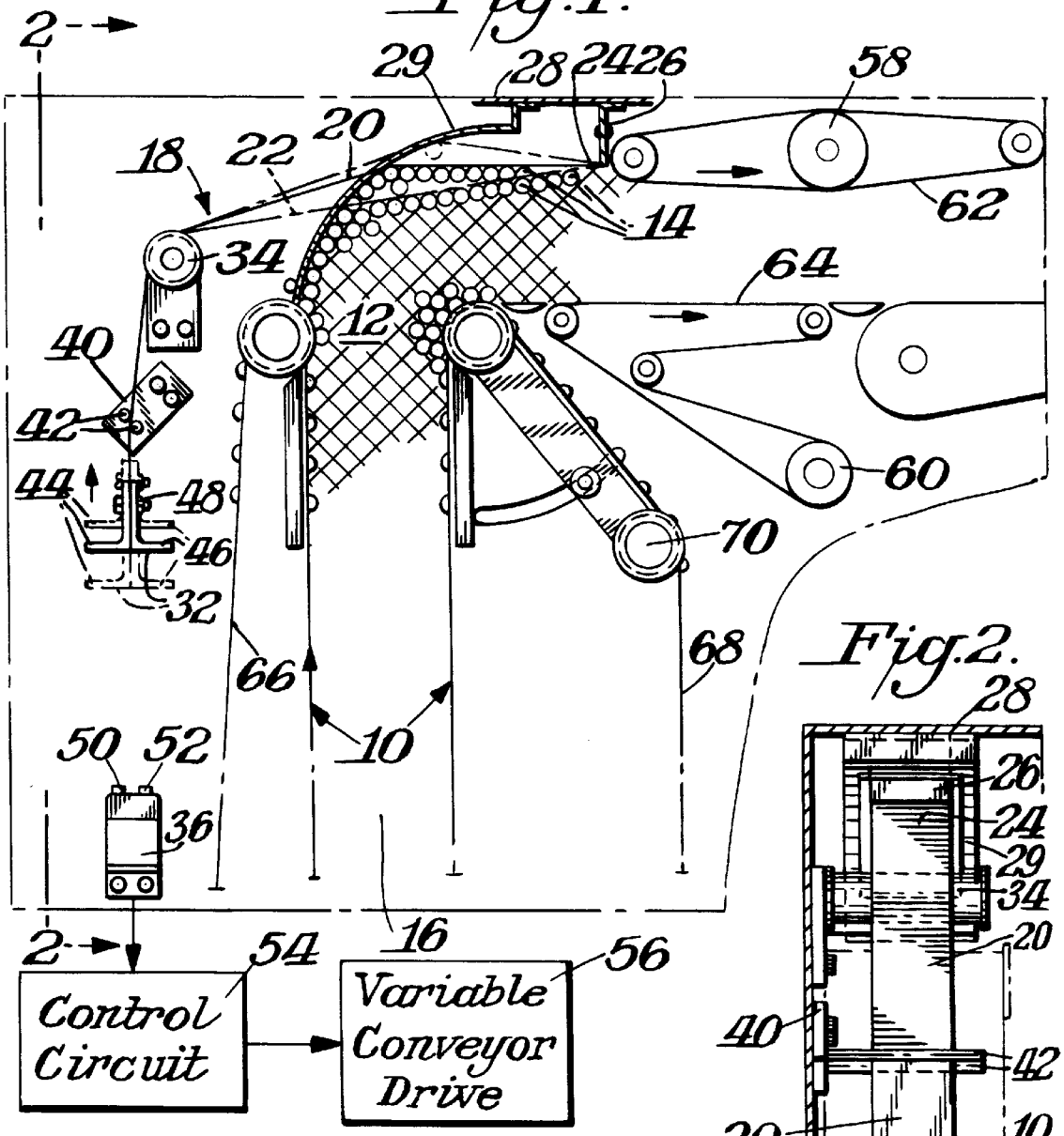
FIG. 1 is a schematic side elevation view of an arrangement for determining the height of a multilayer stream of articles and for varying a conveyor drive in response to such determinations in order to maintain the height of the multilayer stream to within predetermined levels, according to the present invention.
Figure 2:
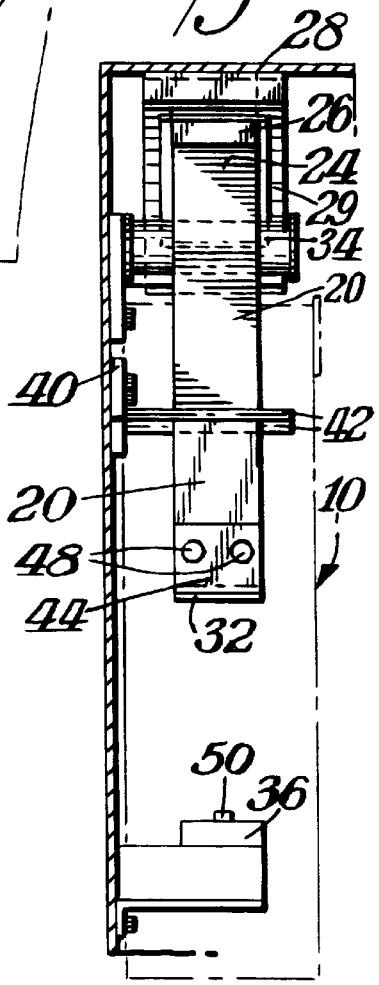
FIG. 2 is a sectional view taken along 2—2 of FIG. 1.

Referring in more particularity to the drawings, FIGS. 1 and 2 illustrate a portion of a conveyor system 10 for transporting a multilayer stream 12 of rod-shaped articles 14, such as cigarettes, from cigarette manufacturing machinery (not shown) along a predetermined path of travel 16 to packaging machinery (not shown). An arrangement 18 is used to determine the height of the multilayer stream of articles 14 at a position 20 along the path of travel 16.

Arrangement 18 comprises a flexible elongate member 22 physically engaging the multilayer stream and connected to move up and down with the uppermost articles 14 of the multilayer stream 12 as the height thereof varies. FIG. 1 shows the flexible elongate member at a position when the height of the multilayer stream is within predetermined limits, and the phantom outlines of the flexible elongate represent heights of the multilayer stream 12 above and below those predetermined limits.

The flexible elongate member 22 has a first end 24 fixed in place to a bracket 26 secured to a housing 28. The flexible elongate member extends through a slotted opening in guide 29 to its opposite end 30, and a weight 32 is secured to that end for movement with the flexible elongate member in response to height variations of the multilayer stream 12 of articles 14.

An idler roller 34 is mounted to the housing 28, and the flexible elongate member 22 is trained around the idler roller, as shown. A sensor 36 is also connected to the housing 28 at a position directly below the weight 32. As explained more fully below, the sensor functions to determine the elevation of weight 32 as it moves up and down with the flexible elongate member 22. Such movement is directly related to the height of the multilayer stream 12 of articles 14.

The arrangement 20 also includes an anti-sway device 40 secured to the housing 28 at a position between the weight 32 and the idler roller 34. Anti-sway device 40 has a pair of spaced apart horizontally oriented posts 42, and the flexible elongate member 22 passes between these posts. The spacing of the posts is such that one surface of the flexible elongate member 22 engages one post while the opposite side of the elongate member engages the other post. This prevents or substantially prevents the weight from swaying.

Preferably, weight 32 comprises a pair of L-shaped elements 44, 46 secured to one another in back-to-back relationship by fastener 48. End 30 of the flexible elongate member is sandwiched between the L-shaped elements to secure the elongate member to the weight. Collectively, the L-shaped elements have an inverted T-shape with a flat lower surface directly above sensor 36.

Sensor 36 includes a transmitter 50 for directing sound onto the lower surface of weight 32 and a receiver 52 for receiving sound reflected from the weight. Circuitry within the sensor detects the delay between the transmitted sound and the received sound and provides a signal indicative of the position of the weight. Such position is directly related to the height of the multilayer stream of articles 14 at position 20. U.S. Pat. No. 4,641,024 and 4,774,840, incorporated herein by reference, illustrate and describe sensors of this type.

The signal from sensor 36 is transmitted to a control circuit 54 coupled to a variable conveyor drive 56 for the overall conveyor system 10. Depending upon the position of weight 32, the control circuit varies the conveyor drive to maintain the height of the multilayer stream 12 of articles 14 to within predetermined limits. When the height of the multilayer stream diminishes, the flexible elongate member 22 is lowered thereby lowering the elevation of weight 32. Sensor 36 detects the lower position of weight 32 and sends an appropriate signal to the control circuit 54. In turn, control circuit 54 sends a signal to the variable conveyor drive to increase the conveyor drive and thereby increase the height of the multilayer stream of articles. Conversely, when the height of the multilayer stream of articles is excessive, the flexible elongate member moves in an upward direction thereby elevating weight 32 away from sensor 36. The increased elevation of weight 32 is determined by sensor 36, and an appropriate signal is transmitted to control circuit 54 which in turn delivers a representative signal to variable conveyor drive 56. The conveyor drive is decreased which lowers the height of the multilayer stream of articles until such height is within predetermined limits.

The overall conveyor system 10 is known in the tobacco industry and this system generally comprises a plurality of drives such as 58, 60 which form part of the variable conveyor drive 56. The conveyor system also includes various belts 62, 64, 66 and 68, for example, as well as an idler tension adjustment roller 70.

What is claimed is:

1. An arrangement for determining the height of a multilayer stream of articles comprising a flexible elongate member connected to move up and down with uppermost articles in the multilayer stream as the height thereof varies, the flexible elongate member having a first end fixed in place and an opposite end, a weight secured to the opposite end of the flexible elongate member movable with the member in response to the height of the mult layer stream of articles, an idler roller about which the flexible elongate member is trained, and a sensor spaced directly below the weight for determining the elevation thereof which is directly related to the height of the multilayer stream of articles.

2. An arrangement for determining the height of a multilayer stream of articles as in claim 1 wherein the flexible elongate member physically engages uppermost articles in the multilayer stream.

3. An arrangement for determining the height of a multilayer stream of articles as in claim 1 wherein each of the articles is rod-shaped.

4. An arrangement for determining the height of a multilayer stream of articles as in claim 3 wherein the rod-shaped articles are cigarettes.

5. An arrangement for determining the height of a multilayer stream of articles as in claim 1 including an anti-sway device for the flexible elongate member positioned between the idler roller and the weight constructed and arranged to engage the flexible elongate member and thereby substantially prevent the weight from swaying.

6. An arrangement for determining the height of a multilayer stream of articles as in claim 1 wherein the weight comprises a pair of L-shaped elements secured to one another in back-to-back relationship with the opposite end of the flexible elongate member sandwiched there between, and wherein the pair of L-shaped elements collectively have an inverted T-shape.

7. An arrangement for determining the height of a multilayer stream of articles as in claim 1 wherein the sensor includes a transmitter for directing sound towards the weight and a receiver for receiving sound reflected from the weight, and means for measuring the delay in receiving sound transmitted towards and reflected from the weight.

8. An arrangement for determining the height of a multilayer stream of articles as in claim 1 in combination with a conveyor system having a variable drive for moving the stream of multilayer articles along a predetermined path of travel, and a control between the sensor and the variable conveyor drive for varying the drive in response to varying positions of the flexible elongate member and its associated weight.

9. A combination as in claim 8 wherein each of the articles is rod-shaped.

10. A combination as in claim 9 wherein the rod-shaped articles are cigarettes.

11. A combination as in claim 10 including an anti-sway device for the flexible elongate member positioned between the idler roller and the weight constructed and arranged to engage the flexible elongate member and thereby substantially prevent the weight from swaying.

12. A combination as in claim 11 wherein the weight comprises a pair of L-shaped elements secured to one another in back-to-back relationship with the opposite end of the flexible elongate member sandwiched there between, and wherein the pair of L-shaped members collectively have an inverted T-shape.

* * * * *